US006210243B1

(12) United States Patent
Nakase

(10) Patent No.: US 6,210,243 B1
(45) **Date of Patent: *Apr. 3, 2001**

(54) FUEL PUMP ARRANGEMENT FOR WATERCRAFT

(75) Inventor: Ryoichi Nakase, Iwata (JP)

(73) Assignee: Yamaha Hatsudoki Kabushiki Kaisha, Iwata (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/099,286

(22) Filed: Jun. 18, 1998

(30) Foreign Application Priority Data

Jun. 18, 1997 (JP) ..... 9-161021

(51) Int. Cl.[7] ..... B63H 21/32

(52) U.S. Cl. ..... 440/88; 440/89; 123/508; 123/509

(58) Field of Search ..... 440/88, 89, 38, 440/900; 123/198 E, 434, 495, 508, 509, 510, 514, 516; 114/55.5, 55.53

(56) References Cited

U.S. PATENT DOCUMENTS

| | | | | |
|---|---|---|---|---|
| 3,948,206 | * | 4/1976 | Tyler | 115/70 |
| 5,103,793 | | 4/1992 | Riese et al. . | |
| 5,309,885 | | 5/1994 | Rawlings et al. . | |
| 5,340,344 | * | 8/1994 | Mineo et al. | 440/88 |
| 5,375,578 | | 12/1994 | Kato et al. . | |
| 5,404,858 | | 4/1995 | Kato . | |
| 5,482,021 | | 1/1996 | Roche . | |
| 5,558,549 | | 9/1996 | Nakase et al. . | |
| 5,562,509 | | 10/1996 | Nakase et al. . | |
| 5,830,021 | * | 11/1998 | Takahashi et al. | 440/88 |
| 5,899,779 | * | 5/1999 | Hattori | 440/88 |
| 5,902,158 | * | 5/1999 | Nakase et al. | 440/88 |
| 5,909,337 | * | 6/1999 | Mashiko | 440/88 |
| 5,921,225 | * | 7/1999 | Nakamura | 123/583 |
| 6,000,371 | | 12/1999 | Henmi | 440/88 |
| 6,016,782 | | 1/2000 | Henmi | 440/88 |
| 6,029,639 | | 2/2000 | Mashiko | 440/88 |
| 6,082,336 | * | 7/2000 | Takahashi et al. | 123/508 |

* cited by examiner

*Primary Examiner*—S. Joseph Morano
*Assistant Examiner*—Lars A. Olson
(74) *Attorney, Agent, or Firm*—Knobbe, Martens, Olson & Bear, LLP

(57) ABSTRACT

A marine engine is constructed having an improved component layout so as to reduce the tendency of an engine fuel pump being exposed to water. This advantage is accomplished while shielding the fuel pump from water that may enter through an access opening above the engine. In one form the fuel pump is mounted under an air intake system of the engine. The fuel pump is also desirably arranged to reduce thermal effects on the fuel pump by positioning the fuel pump on an air intake pipe of the engine. In another from, the fuel pump is mounted under and inclined cylinder block and an exhaust system.

48 Claims, 10 Drawing Sheets

FUEL PUMP ARRANGEMENT FOR WATERCRAFT

BACKGROUND OF THE INVENTION

1. Field of the Invention

The present invention relates in general to an engine, and in particular to a component layout for a marine engine, including an arrangement of the fuel pump.

2. Description of Related Art

Internal combustion engines are commonly used to power small watercrafts such as personal watercraft. These watercraft include a hull which defines an engine compartment Personal watercraft often employ an inline, multi-cylinder, crankcase compression, two-cycle engine. The engine conventionally lies within the engine compartment with the in-line cylinders aligned along a longitudinal axis of the watercraft hull. The output shaft of the engine is coupled to a water propulsion device of the watercraft, such as a jet propulsion unit.

Generally, the engine of the small watercraft also includes an air intake system, an exhaust system, a fuel supply system, and other components to operate the engine. Air is supplied to the engine from the outside of the hull for use in the combustion process. Typically, air flows through one or more ducts in the hull into the engine compartment, and then through the intake system to the cylinders. An exhaust system communicates with the cylinders of the engine and extends to a discharge that is located near the stern of the watercraft.

Fuel is also supplied to the engine for use in the combustion process. In order to accurately meter the fuel and improve engine operating efficiency and performance, the fuel may be injected with one or more fuel injectors. Each injector has an electrically operated valve which selectively opens and closes, controlling the flow of fuel through the injectors to the engine. In this arrangement, fuel is supplied to the fuel injectors at a high pressure by a fuel pump.

Personal watercraft also commonly include an access opening that is formed in the watercraft deck above the engine. A longitudinally extending, straddle-type seat normally covers the access opening to close the engine compartment. On occasions, a rider may need to open the access opening while the watercraft is floating in a body of water in order to make minor repairs or adjustments.

Prior arrangements of the fuel pump within the engine compartment posed the risk that water could enter the engine compartment through the uncovered access opening and contact the fuel pump, which consequently could damage the fuel pump and/or its electrical contacts. In addition, water that enters the engine compartment also tends to splash about within the engine compartment due to the pitching and rocking movement of the watercraft as it moves through the water With either direct contact or subsequent internal splashing, the water can corrode or otherwise damage the pump and/or interrupt the electrical current flow to the pump. In some cases, this may permanently damage the pump as well as affect the operation of the engine.

SUMMARY OF THE INVENTION

To overcome this problem, the present invention positions the fuel pump directly onto the engine housing in one of multiple locations. In each location, the fuel pump is at least partially shielded from water that enters into the engine compartment either directly through the access opening or indirectly due to splashing of water that has accumulated in the bottom of the engine compartment In accordance with one aspect of the present invention, a watercraft comprises a hull that defines an engine compartment and an engine contained within the engine compartment. The engine compartment has an access opening positioned above the engine for access thereto. The engine includes an air intake system and a fuel pump supplying fuel to the engine. The fuel pump is positioned on the engine so as to be at least partially shielded from water that may pass through said access opening in said engine compartment.

Further aspects, features, and advantages of the present invention will become apparent from the detailed description of the preferred embodiments that follow.

BRIEF DESCRIPTION OF THE DRAWINGS

The above-mentioned and other features of the invention will now be described with reference to the drawings of preferred embodiments of the present watercraft. The illustrated embodiments are intended to illustrate, but not to limit the invention. The drawings contain the following figures.

DETAILED DESCRIPTION OF PREFERRED EMBODIMENTS OF THE INVENTION

The present invention has particular utility for use with a personal watercraft. Before describing the present invention, however, an exemplary personal watercraft will first be described in general details to assist the reader's understanding of the engine. The exemplary watercraft is suited for movement through a body of water toward a front end or bow of the watercraft.

Figure 1:
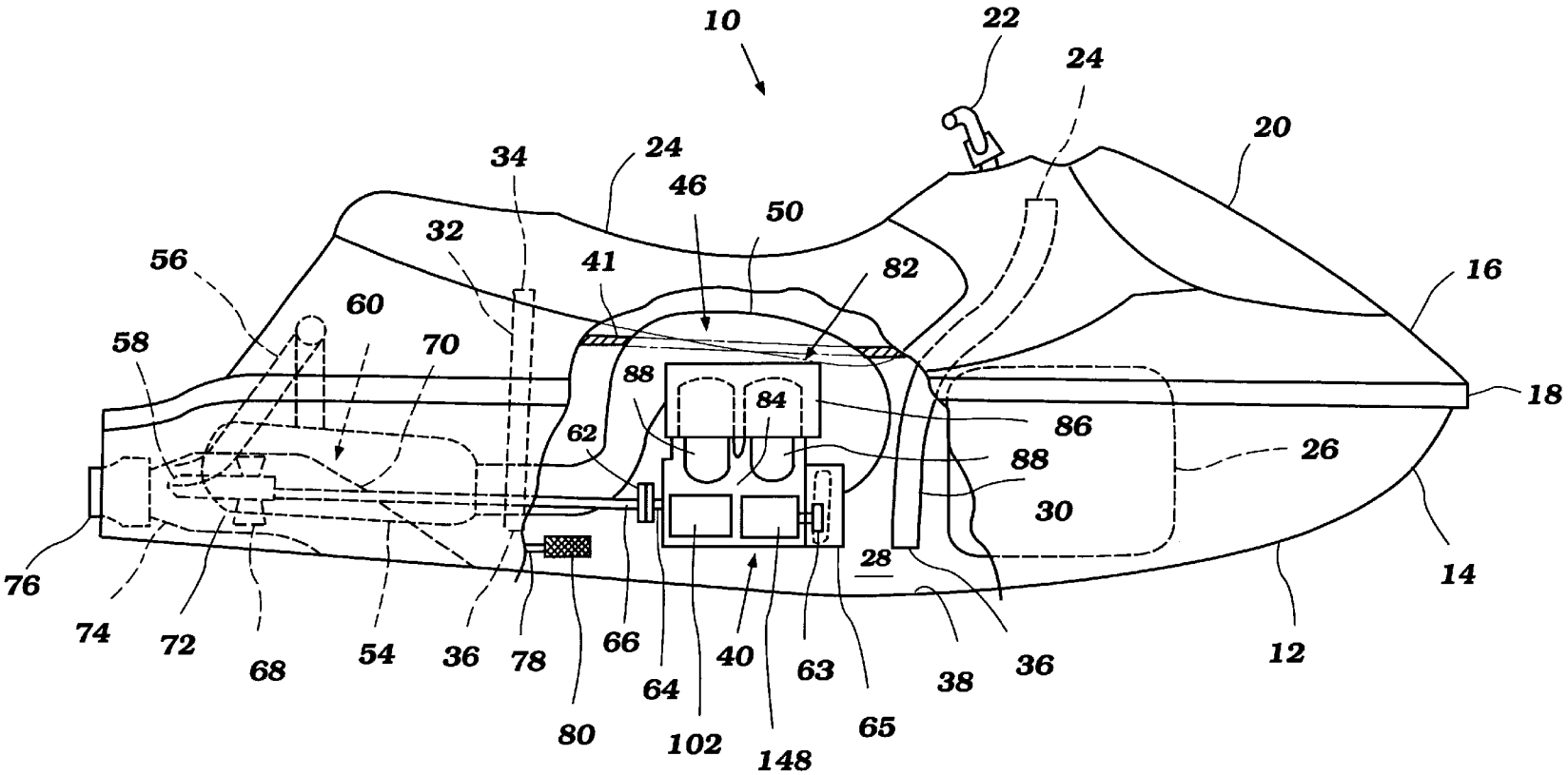
FIG. 1 is a side elevational view of an embodiment of the present invention showing a watercraft partially sectioned to illustrate an interior engine compartment that houses an engine configured and arranged in accordance with the present invention.

As illustrated in FIG. 1, a watercraft 10 includes a hull 12 formed by a lower hull section 14 and an upper deck section 16. The hull sections 14, 16 are formed from a suitable material such as, for example, a molded fiberglass-reinforced resin. The lower hull section 14 and the upper deck section 16 are fixed to each other around the peripheral edges 18 in any suitable manner.

As viewed in the direction from the bow to the stem of the watercraft 10, the upper deck section 16 includes a bow portion at the front of the watercraft, a control portion extending rearward therefrom, and a seating area extending from the control area toward the back of the watercraft. The bow portion slopes upwardly toward the control portion and includes an opening (not shown) for access to the interior of the watercraft hull 12. A hatch or lid 20 covers the opening to inhibit an influx of water into the hull 12, and also slopes upwardly to the control portion.

The control portion extends rearward from the bow portion and includes a display panel (not shown) and a handlebar assembly 22. The handlebar assembly 22 controls the steering of the watercraft 10 in a conventional manner and also carries a variety of watercraft controls, such as, for example, a throttle control, a start switch and a lanyard switch.

The seating area is, as shown in FIG. 1, comprises an operator/passenger seat 24 detachably mounted longitudinally along the center of the watercraft 10 that may be straddled by an operator, in the middle of the watercraft, and by at least one or two passengers to the rear during use. The middle position of the operator on the watercraft 10 gives the watercraft 10 fore and aft balance when the operator rides alone. Although not illustrated, the seat 24 can be made as two discrete sections: a front seat section and a rear seat section, both detachably mounted separately to the upper deck section 16 using known latching mechanisms.

The lower hull section 14 of the personal watercraft 10 includes within its interior an engine compartment 28 that houses the engine and peripheral components and/or systems below the seat 24. Such peripheral systems include an air intake system, a fuel delivery system, and an exhaust system. Typically, a fuel tank 26 and a buoyant block (not shown) are located within the lower hull section 14 directly in front of the engine compartment 28. The fuel tank 26 is mounted to the bottom surface 38 of the lower hull 14 using a plurality of fuel tank mounts (not shown). The buoyant block adds buoyancy to the watercraft 10.

Typically, an air supply system ventilates the engine compartment 28 by supplying fresh air thereto. Such an air supply system desirably includes at least one air duct, and preferably at least two. For example, one air duct 30 may be located toward the front of the engine compartment 28 while another air duct 32 is provided toward the rear of the engine compartment. Both ducts 30, 32 preferably include an upper end 34 that extents up into the upper deck section 16 and a lower end outlet 36 that terminates close to and just above a bottom surface 38 of the engine compartment 28.

An internal combustion engine 40, which powers the watercraft 10, is housed within the engine compartment 28 and is mounted in approximately a central position in the watercraft 10. Separating the engine compartment 28 from the seat 24 is an access opening 41 defined in the upper deck section 16. The seat 24 covers the access opening 41 so that the removal of the seat 24 exposes the engine 40 within the engine compartment 28. Typically, the engine 40 comprises a plurality of in-line cylinders 42 that operate on a two-cycle principle, although types of engines are suitable, e.g., four cycle, crankcase compression, etc. The engine 40 is preferably positioned such that the row of in-line cylinders 42 lies parallel to a longitudinal axis 44 of the watercraft 10 that runs bow to stern. The engine 40 and its peripheral systems (air intake, fuel delivery, and exhaust systems) interconnect with one another within the engine compartment 28. To the rear of the engine compartment is a jet propulsion unit 60, described further below.

With continuing reference to FIG. 1, extending rearward from a lower portion of the engine 40 is a drive shaft 62 that is connected by a coupling 64 to an impeller shaft 66. The impeller shaft 66 extends rearward through a bulkhead and a protective sleeve (not shown), to the jet propulsion unit 60. A bearing assembly (not shown), which is secured to the bulkhead supports the impeller shaft 66 behind the shaft coupling 62. The engine powers the drive shaft in a rotational manner so as to rotate the impeller 68 positioned at the rearward most end of the impeller shaft 66 to propel the watercraft 10.

The jet propulsion unit 60 is positioned in a tunnel in the rear center of the lower hull section 14. The jet propulsion unit 60 includes a gullet 70 having an inlet opening formed on the bottom side of the lower hull section 14. The gullet 70 extends from the inlet opening to a pressurization chamber 72 which, in turn, communicates with a reduced-diameter nozzle section 74 of the propulsion unit 60. The jet propulsion unit 60 also includes the rotatable impeller 68 supported by the impeller shaft 66.

When rotating at high speeds, the impeller 68 pressurizes the water within the pressurization chamber 72 and forces the pressurized water through the nozzle section 74 of the jet propulsion unit 60. A steering nozzle 76 directs the exit direction of the water stream exiting the jet propulsion unit 60. The steering nozzle 76 is pivotally supported at the rear of the jet propulsion unit 60 to change the thrust angle on the watercraft 10 for steering purposes, as is known in the art. The steering nozzle 76 is connected to the steering handlebar 22 so as to be directed thereby. The steering handle 22 may also include a throttle control for controlling the output of the engine 40 and, thus, the speed of the impeller 68.

The impeller 68 is located toward the front end of the pressurization chamber 72. A central support (not shown) supports the rear end of the impeller shaft 66 behind the impeller 68 and generally at the center of the pressurization chamber 72. A bearing assembly (not shown) journals the rear end of the impeller shaft 66 within the support.

Within the engine compartment, a water removal system is provided that is in fluid communication with the nozzle section 74 of the propulsion unit 60. Preferably, the water removal system comprises a bilge system that, as illustrated in FIG. 1, employs a conduit 78 that extends from an inlet in the engine compartment to the nozzle section 74. Due to the high rate of water flow through the nozzle section 74, a venturi effect is created that creates suction in the conduit 78. That suction effect draws water out of the engine compartment through a bilge inlet or water pickup 80 adjacent the engine 40 and near the bottom surface 38 of the lower hull section 14. As illustrated in FIG. 1, the water-pickup 80 is arranged to be slightly elevated from the bottom surface 38 of the hull 12 of the engine compartment 28.

Alternatively, the water removal system may employ a conventional pump (not shown) that directs water from the bilge region of the hull 12 through the conduit 78 to an outlet (not shown) at the stem of the watercraft 10. For example, the water may be expelled through an outlet located in a wall of the gullet 70.

Figure 2:
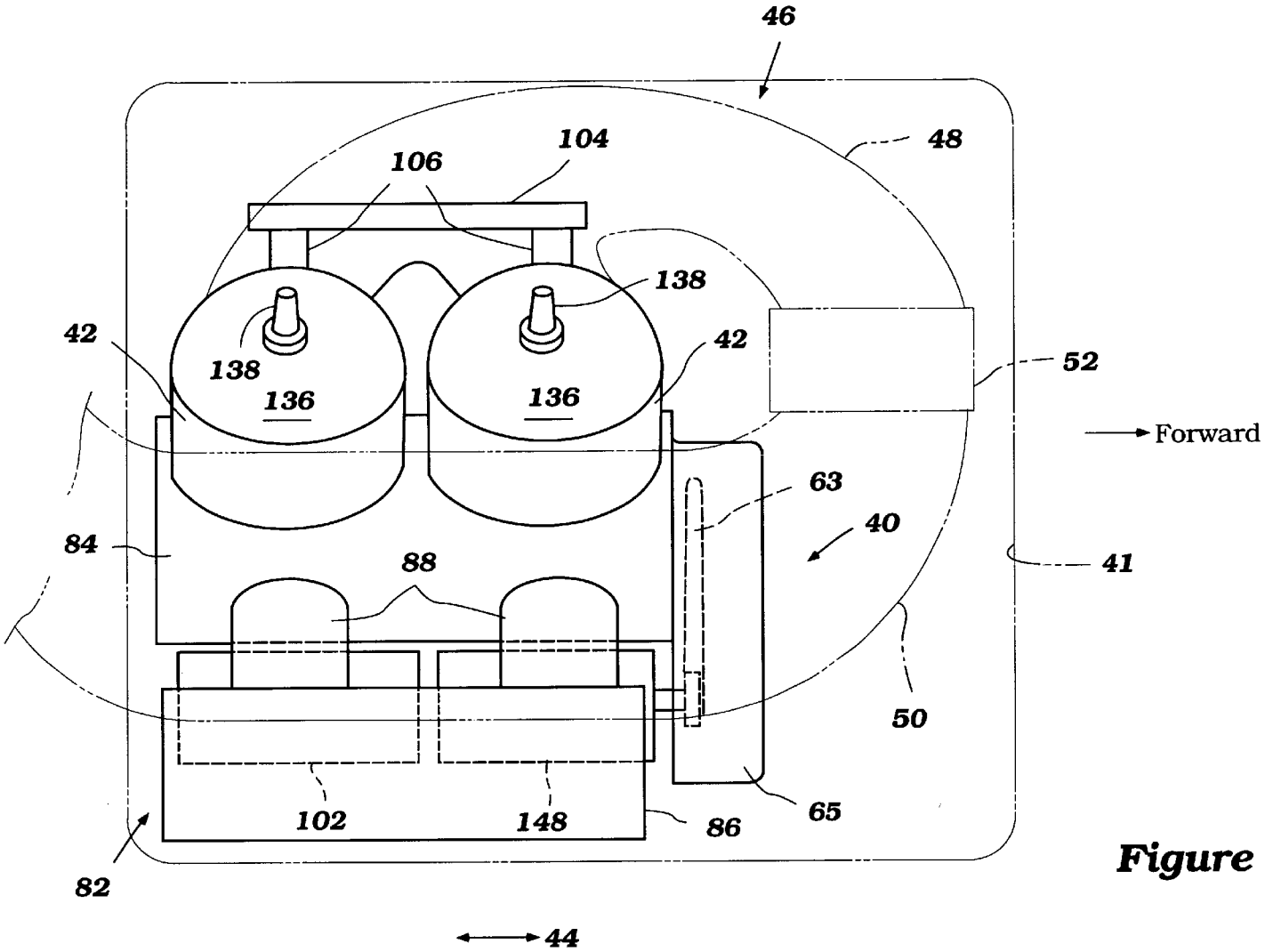
FIG. 2 is a partial top plan view of the embodiment of FIG. 1.
Figure 3:
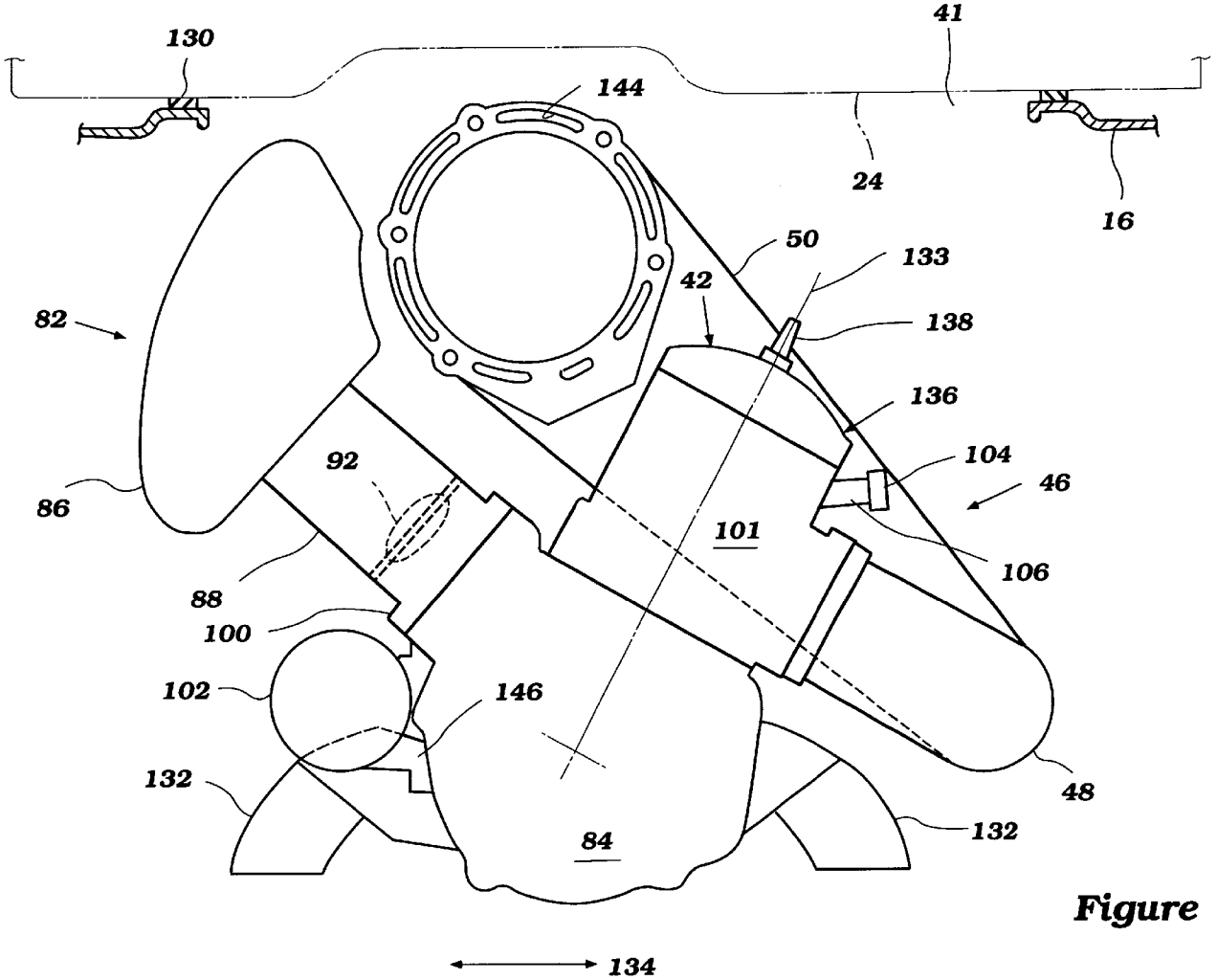
FIG. 3 is a front elevational view of the embodiment of FIG. 1.

In the embodiments illustrated in FIGS. 2 and 3, exhaust gases from the engine 40 are discharged to the water through an exhaust system 46. The exhaust system 46 includes an exhaust manifold 48, which is connected to the exhaust output of the engine 40, and an exhaust pipe 50, which communicates and receives exhaust gases from the exhaust manifold 48 via an expandable joint 52. In the illustrated embodiment, the exhaust pipe includes an expansion chamber. The outlet of the exhaust pipe 50 communicates with a water trap device 54, located toward the rear of the watercraft 10, which inhibits the backflow of cooling water toward the exhaust pipe 50. An exhaust discharge pipe 56 connects the water trap 54 to a discharge opening 58. The exhaust discharge pipe 56 extends over the jet propulsion unit 60 to further inhibit the influx of water into the exhaust system 46.

An air intake or induction system 82 supplies an air charge to a plurality of crankcase chambers (not shown) formed within a crankcase 84 of the engine 40. Air is received by the air intake system 82 through an intake air silencer 86. In the illustrated embodiment, the silencer 86 is located above and to the side of the cylinders 42. The silencer 86 includes a plenum chamber (not shown). The plenum chamber of the silencer communicates with a plurality of intake pipes 88 (only one shown). The engine 40 preferably includes an intake pipe 88 for each crankcase chamber and associated cylinder 42.

A throttle valve is housed within each intake pipe 88 and comprises a butterfly-type valve disc 92. Each throttle valve 92 communicates with an intake passage of an intake manifold 100 attached to the crankcase 84 and/or to the cylinder block 101.

Figure 4:
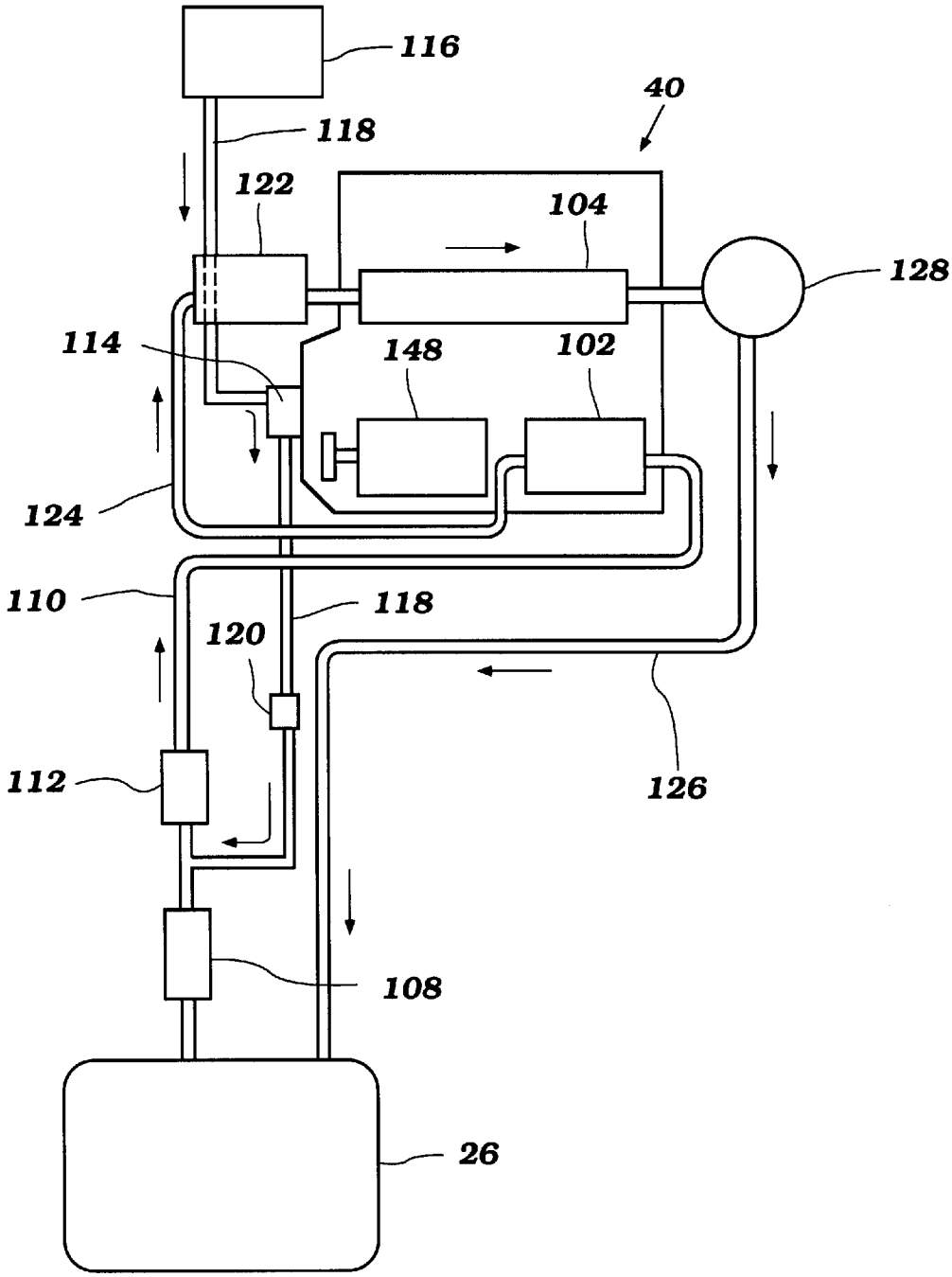
FIG. 4 is a block diagram, illustrating the fuel supply system employed in the first embodiment of the present invention.

A fuel supply system of the engine 40 includes a fuel pump 102, a fuel rail 104, fuel injectors 106, and fuel pipes interconnecting thereof. FIG. 4 schematically illustrates the fuel supply system of preferred embodiments of the present invention. Fuel is transferred from the fuel tank 26 to the fuel pump 102, and then supplied to the fuel injector 106 (shown in FIGS. 2, 3, 5, 6, and 9) by the fuel pump 102. The fuel pump 102 can be either mechanically or electrically driven. The pump could also be a diaphragm pump operated by the changing pressure within one of the crankcase chambers.

A feed pump 108 sends fuel from the fuel tank 26 to the fuel pump 102 through a fuel intake pipe 110. A water separator filter 112 between the fuel tank 26 and the fuel pump 102 separates water and other contaminants from the fuel. A lubricant pump 114 supplies lubricant (e.g., oil) from the lubricant tank 116 to the water separator filter through an oil pipe 118. As a result, the oil mixes with the fuel before the fuel is injected into the engine 40. An oil flow control valve 120 is located in the oil pipe 118 between the oil pump 114 and the water separator filter 112, and meters oil into the water separator filter 112 at a rate corresponding to the operating condition of the engine 40. The fuel from the water separator filter 112 is transferred to the fuel pump 102. The fuel pump 102 supplies the fuel to a fuel filter 122 located between the fuel pump 102 and the fuel rail 104 in a fuel supply pipe 124. The fuel filter 122 separates water and other contaminants from the fuel. The filtered fuel next is delivered to the fuel rail 104 where fuel is distributed to the fuel injectors 106 connected thereto. Residual fuel is directed out of the fuel rail 104 to a return line 126 to the fuel tank 26. A pressure regulator 128 is located within this return line 126 to maintain the pressure within the return line 126.

With reference now to FIG. 3, the illustrated engine 40 is desirably mounted beneath the access opening 41 within the engine compartment 28. A seal member 130 is provided around the access opening 41 to prevent water influx into the engine compartment 28.

A plurality of engine mounts 132 secure the engine 40 to the hull 12 and support the engine 40 within the engine compartment 28 of the watercraft 10. Each engine mount 132 preferably comprises a pad constructed from rubber or a similar vibration dampening and isolating material to reduce vibration transmission between the engine 40 and the hull 12.

As shown in FIG. 2, the engine 40 is positioned such that the row of cylinders lies in the longitudinal direction 44 of the watercraft 10. As shown in FIG. 3, the engine 40 is arranged so that the each cylinder 42 is desirably inclined such that a longitudinal center plane 133 of the cylinders 42 is skewed in a lateral direction 134 of the watercraft 10. The illustrated engine 40 also extends substantially longitudinally; notably, the engine 40 can also be arranged with the output shaft 64 oriented generally in the lateral direction 134.

As shown in FIGS. 2 and 3, the crankcase 84 is located beneath the cylinder block 101. Integral with the cylinder block 101 are the cylinders 42. A cylinder head assembly 136 is provided to enclose each cylinder 42. A spark plug 138 is mounted on top of each cylinder head 136 and has its gap extending into the combustion chamber. The spark plugs 138 are fired by an ignition control unit (not shown) that is controlled by an electronic control unit (not shown) of the engine 40. A fuel injector 106 is provided to each cylinder 42. Each fuel injector 106 communicates with the fuel rail 104 through which fuel is supplied by the fuel pump 102, as described above. In the illustrated embodiment, each fuel injector communicates with a combustion chamber of the respective cylinder through a wall of the cylinder; however, the fuel injector can also communicate with the combustion chamber through the cylinder head.

The exhaust manifold 48 is affixed to the cylinder block 101 on one side of the inclined cylinder center plane 133 to receive exhaust gases from the combustion chambers. As shown in FIG. 2, the exhaust manifold 48 receives exhaust gases from each cylinder 42 and communicates with the exhaust pipe 50 via the elastic joint 52. The exhaust pipe 50 loops around a front end of the cylinder block 101 and extends along the other side of the inclined cylinder center plane 133. The exhaust pipe 50 desirably includes an inner tube that communicates directly with the discharge end of the exhaust manifold 48. An outer tube surrounds the inner tube to form a coolant jacket 144 between the inner and outer tubes. In the illustrated embodiment, the inner tube terminates within the outer tube at a point behind the engine so as to merge at least a portion of the cooling water with the exhaust flow through the exhaust pipe.

With reference to FIGS. 2 and 3, on the a side of the crankcase 84 opposite to the side of the cylinder 42 from which the exhaust manifold 48 passes, the air intake system 82 is provided to supply an air charge to a plurality of crankcase chamber formed within the crankcase 84. The air intake manifold 100 is affixed to the crankcase 84, and the air intake system 82, including the air intake pipe 88 and the intake silencer 86, extends upwardly from the intake manifold 100. The air intake silencer 86 is located above and to the side of the cylinder block 101.

As described above, fuel is supplied to the fuel injectors 106 through the fuel supply system, which includes the fuel pump 102 and the fuel rail 104. In the first embodiment, the fuel pump 102 is mounted on the crankcase 84 below the air intake manifold 100. A bracket 146 connects the fuel pump 102 to the side of the crankcase 84. Advantageously, the bracket 146 includes an elastic material, such as rubber, to avoid transferring the vibration of the engine 40. The fuel pump 102 is arranged on the engine 40 such that the air intake pipe 88 and the air intake silencer 86 extend above at least a portion of the fuel pump 102, as shown in FIG. 2. Advantageously, at least either the air intake silencer 86 or the intake pipe 88 shields the fuel pump 102 above it. Thus, although water may enter inadvertently the engine compartment 28 through the uncovered access opening 41, the fuel pump 102 may be protected against water contact.

With reference to FIG. 1, the fuel pump 102 is advantageously positioned above the level of the water pickup 80 of the bilge system such that water that enters the engine compartment 28 may not fill to the level of the fuel pump 102 within the watercraft hull 12. Further, the fuel pump 102 advantageously is in a position higher than the outlet 36 of the air ducts 30, 32 so as to inhibit water that may enter the engine compartment 28 through the air ducts 30, 32 from contacting the fuel pump 102. The fuel pump 102 also desirably lies between the front end of the engine and the shaft coupling 62. In the illustrated embodiment, the fuel pump 102 thus lies between the locations of a flywheel-magneto assembly 63 and the coupling 62 so as not to be affected by the vibration thereof.

In the illustrated embodiment, a flywheel cover 65 encloses the flywheel-magneto assembly 63 on the front end of the engine 40; however, in accordance with other variations the flywheel-magneto assembly 63 can be located at the rear of the engine 40. As understood from FIG. 2, the flywheel of the assembly 63 is coupled to a front end of the crankshaft 64. For this purpose, the flywheel desirably is mounted to a shaft (not shown) that is connected to the crankshaft 64. A pulsar coil is used with the flywheel-magneto assembly 63 to produce a signal indicative of a particular crankshaft angle. The signal pulse desirably is received and processed by an ECU to determine the specific crankshaft angle at a given time for ignition and fuel injection timing, as known in the art. The flywheel-magneto assembly 63 also desirably includes a charging coil to charge a conventional capacitor discharge ignition circuit (CDI).

Figure 10:
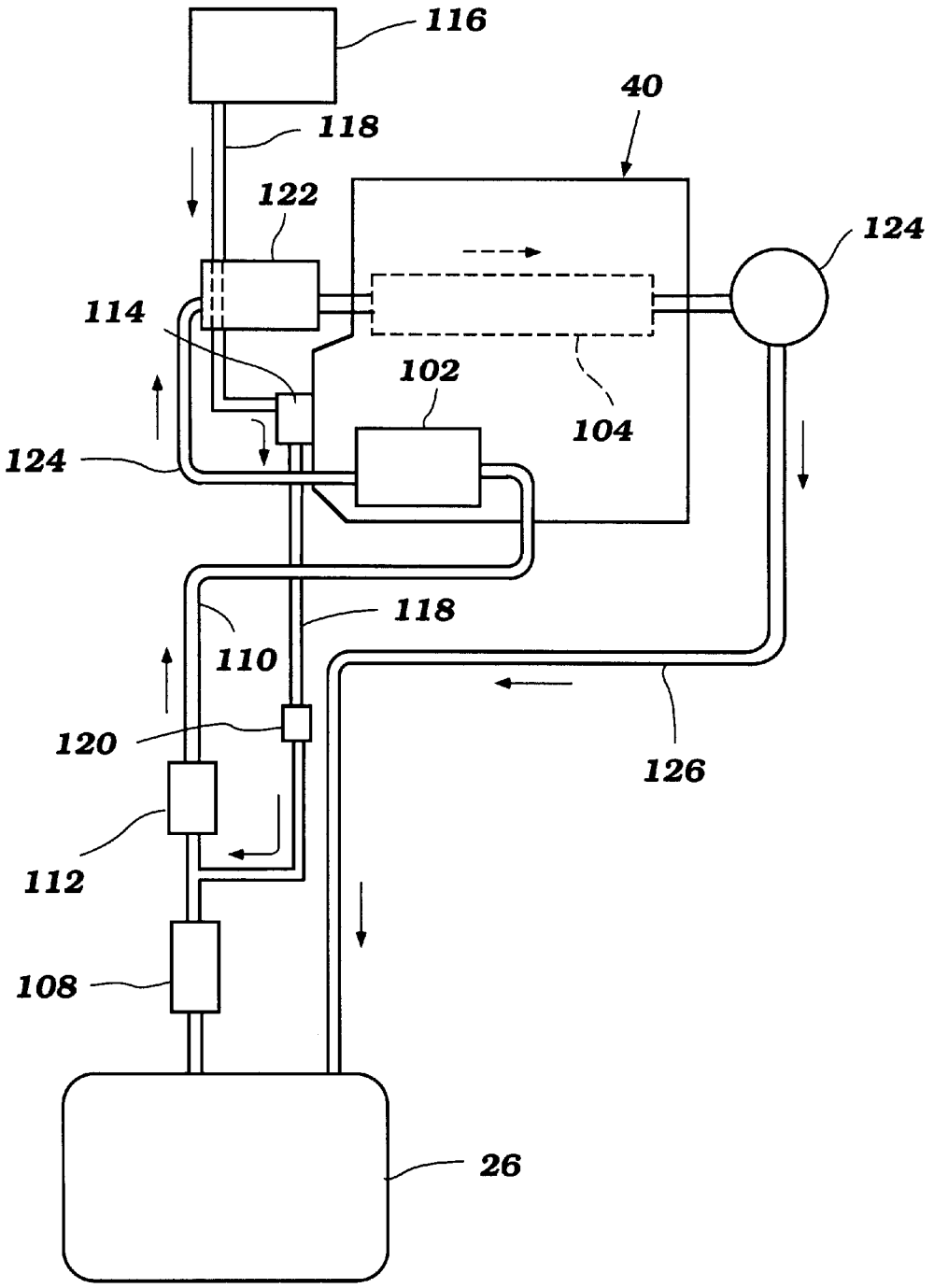
FIG. 10 is a schematic block diagram of the fuel supply system, similar to FIG. 4, but illustrates a forward position of the fuel pump on the engine.

As shown in FIGS. 1 and 2, a starter motor 148 is advantageously arranged on the engine 40 in line with the fuel pump 102 in the longitudinal direction 44 such that the air intake pipe 88 and the air intake silencer 86 also extend above at least a portion of the starter motor 148. In the embodiment illustrated in FIGS. 1–4, the starter motor 148 is positioned in front of the fuel pump 102 so as to lie near the flywheel assembly 63. A pinion of the starter motor 148 drives a ring gear of the flywheel assembly 63 as known in the art. The starter motor 148 can also lie at other locations on the engine relative to the fuel pump 102. For instance, as understood from FIG. 10, the fuel pump 102 can lie near the front end of the engine 40 on one side and the starter motor 148 can lie on the other side. The positions of the fuel pump 102 and the starter motor 148 can also be reversed from that depicted in FIG. 1 when the flywheel assembly 63 is located at a rear end of the engine 40.

With the fuel pump 102 positioned below the intake system, either the air intake silencer 86 or the air intake pipe 88 advantageously shields the starter motor 148 above it. Further, the starter motor 148 is advantageously arranged on the engine 40 at the same level as the fuel pump 102. The starter motor 148 thus also enjoys the advantages of the arrangement of the fuel pump 102 with respect to water that accumulates in the bottom of the engine compartment 28.

Figure 5:
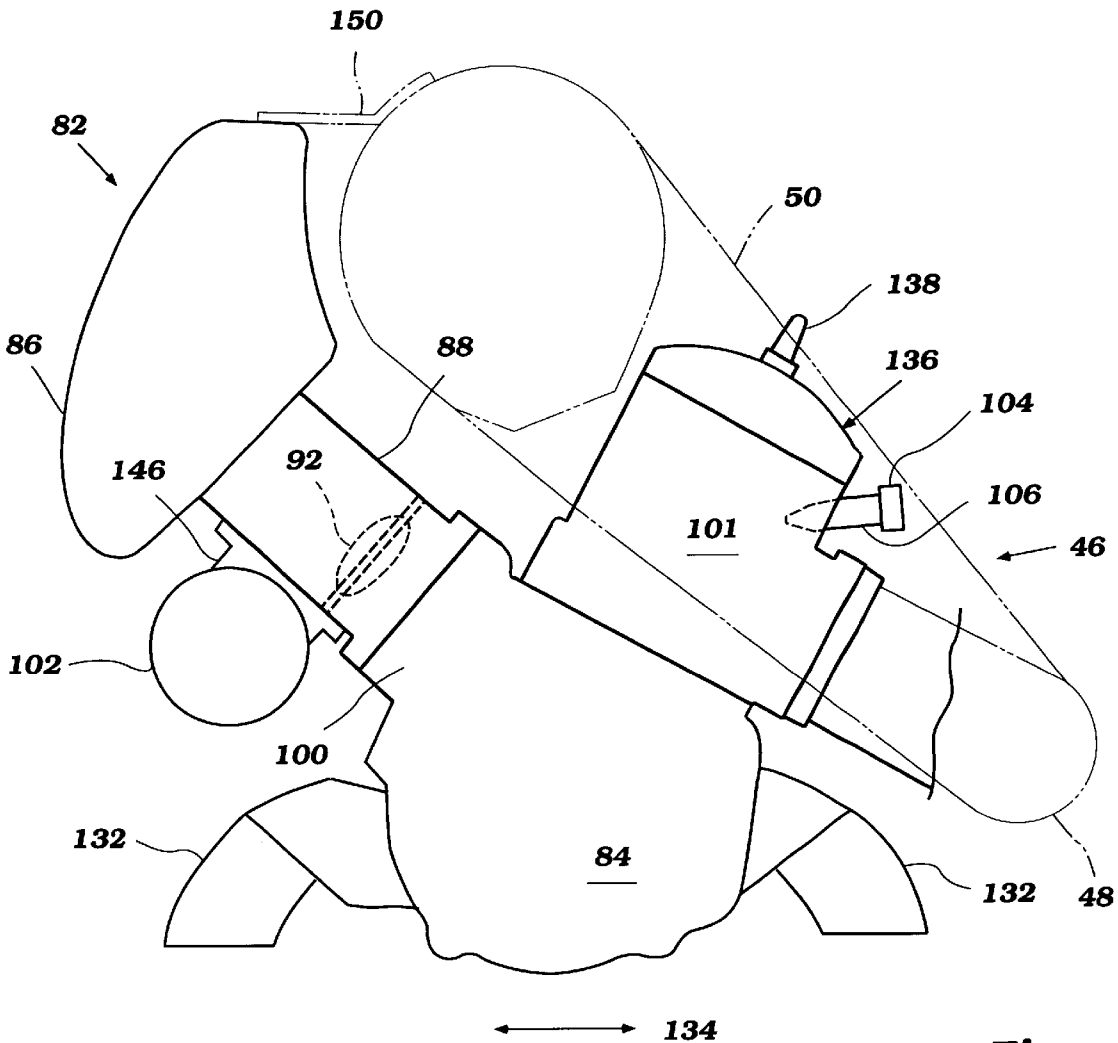
FIG. 5 is a front elevational view of another embodiment of an engine configured and arranged in accordance with the present invention.

FIG. 5 illustrates another embodiment of the engine arrangement of the present invention. In connection with the following embodiments, like elements between the embodiments are referred by like numerals, and the foregoing description of like components between the embodiments should be understood to apply equally to all embodiments, unless indicated otherwise.

As illustrated, the fuel pump 102 is mounted on a lower surface of one of the air intake pipes 88 via a bracket 146, by which the air intake pipe 88 shields the fuel pump 102 from water contact. Since the fuel pump 102 is still located under the air intake silencer 86, the fuel pump 102 can be protected by the intake silencer 86 as well. Further, advantageously, relatively low temperature air, which passes through the air intake pipe 88, can cool the fuel pump 102.

Figure 6:
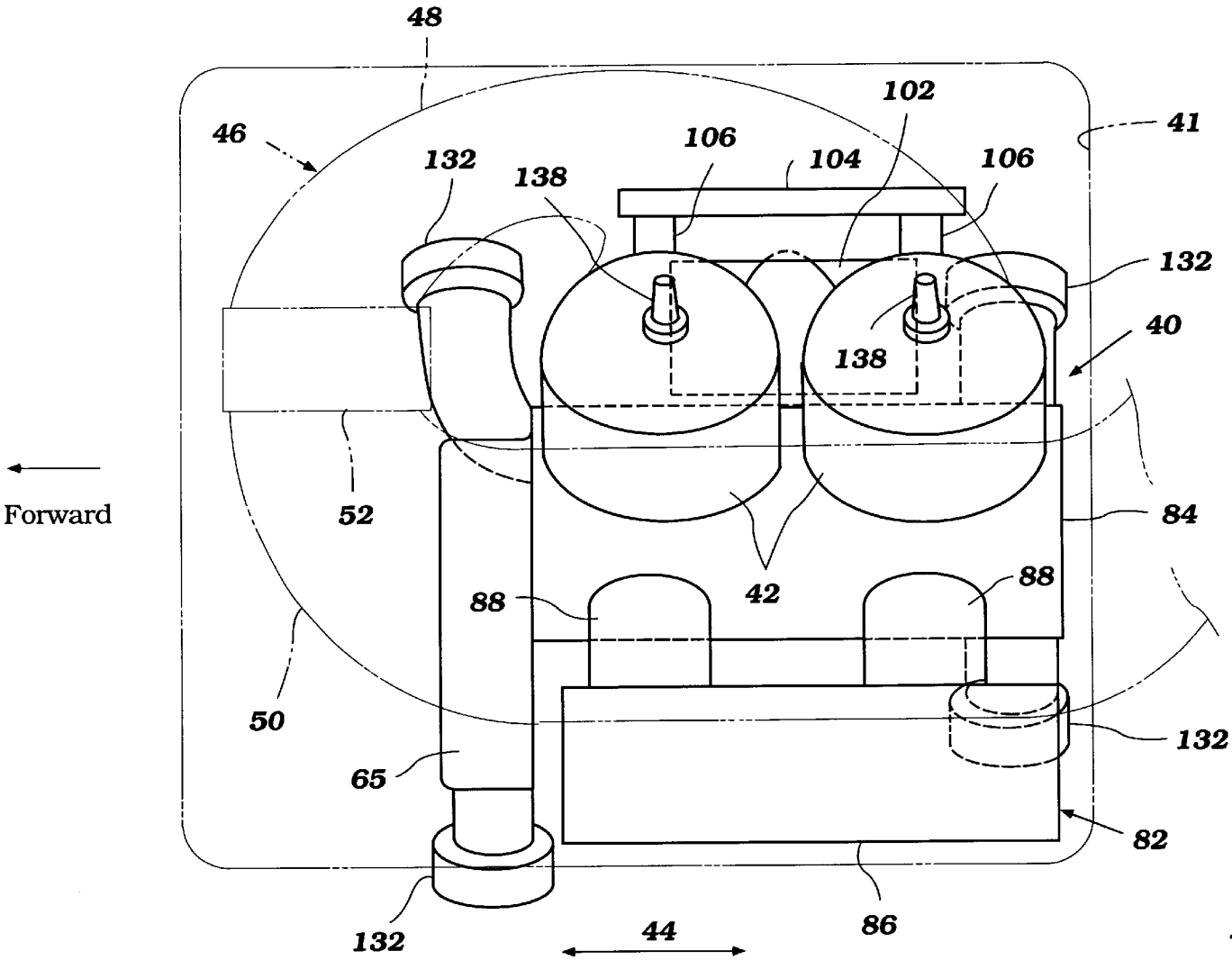
FIG. 6 is a partial top plan view of an additional embodiment of an engine configured and arranged in accordance with the present invention.
Figure 7:
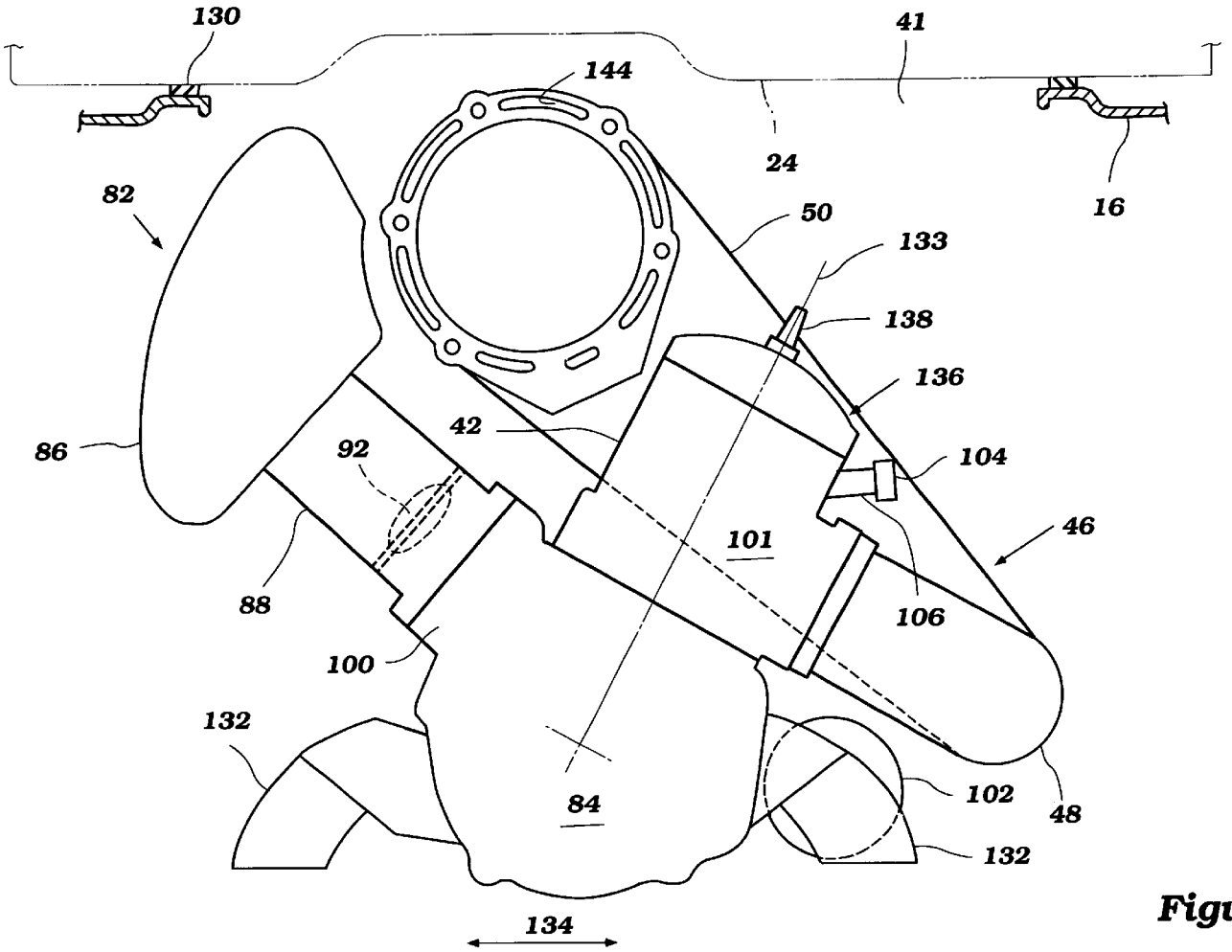
FIG. 7 is a front elevational view of the engine of FIG. 6.

An additional embodiment of the fuel pump arrangement according to the present invention is illustrated in FIGS. 6 and 7. The fuel pump 102 of this embodiment is mounted on the side of the crankcase 84 where the exhaust manifold 48 is affixed. Although not illustrated, a bracket connects the fuel pump 102 to the crankcase side as described in connection with FIGS. 3 and 5. As illustrated, the fuel pump 102 is placed under the inclined cylinder block 101 and the exhaust manifold 48. Thus, the exhaust manifold 48 and the cylinder block 101 shield at least a part of the fuel pump 102 from the water that may enter the engine compartment 28. Also, the fuel pump 102 is located between a pair of engine mounts 132 on the exhaust manifold side of the crankcase 84. The engine mounts 132 located at both sides of fuel pump 102 may block the water that may splash about within the engine compartment 28 due to the pitching of the watercraft 10 as it moves through the water.

Figure 8:
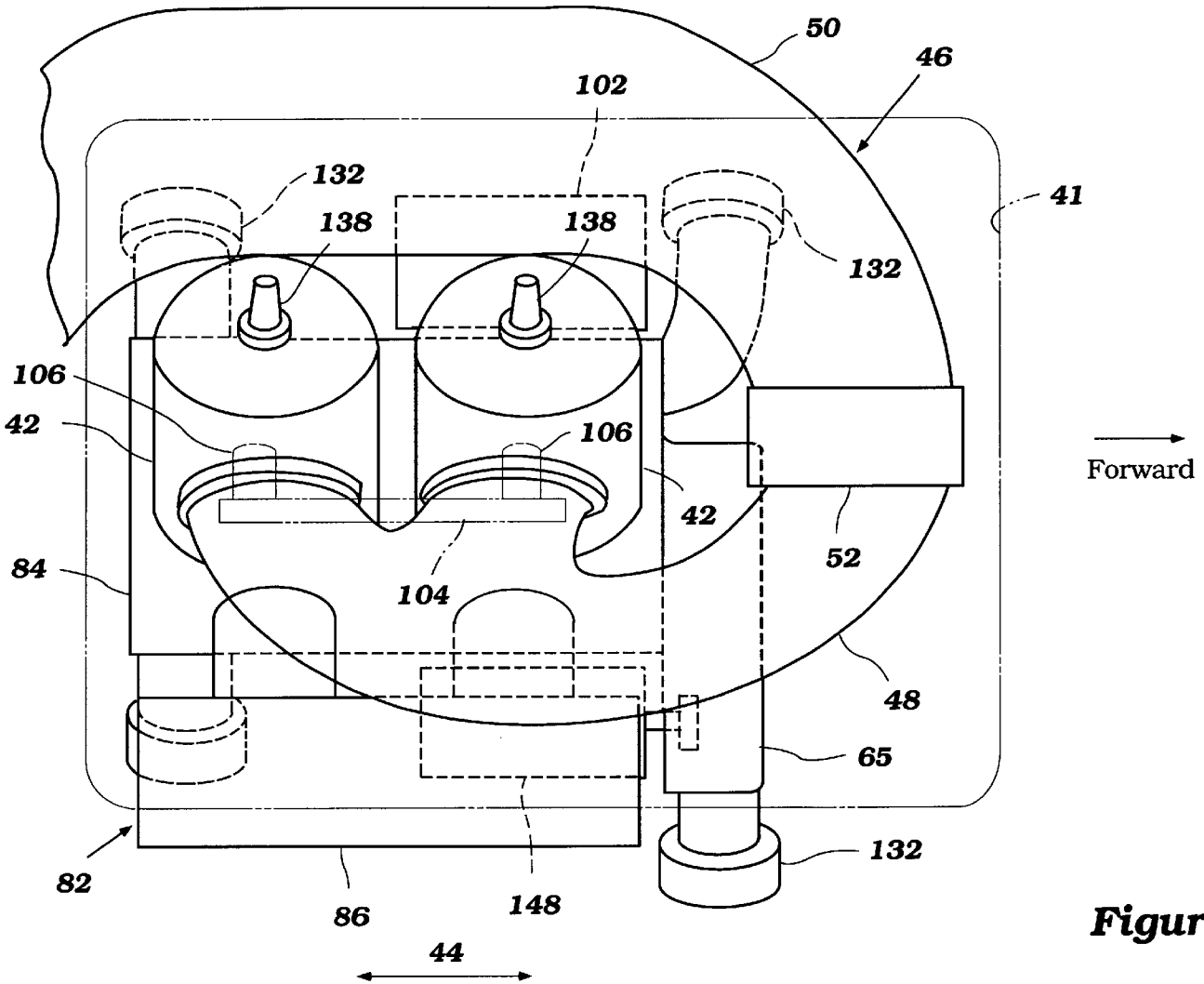
FIG. 8 is a partial top plan view of another embodiment of an engine configured and arranged in accordance with the present invention.
Figure 9:
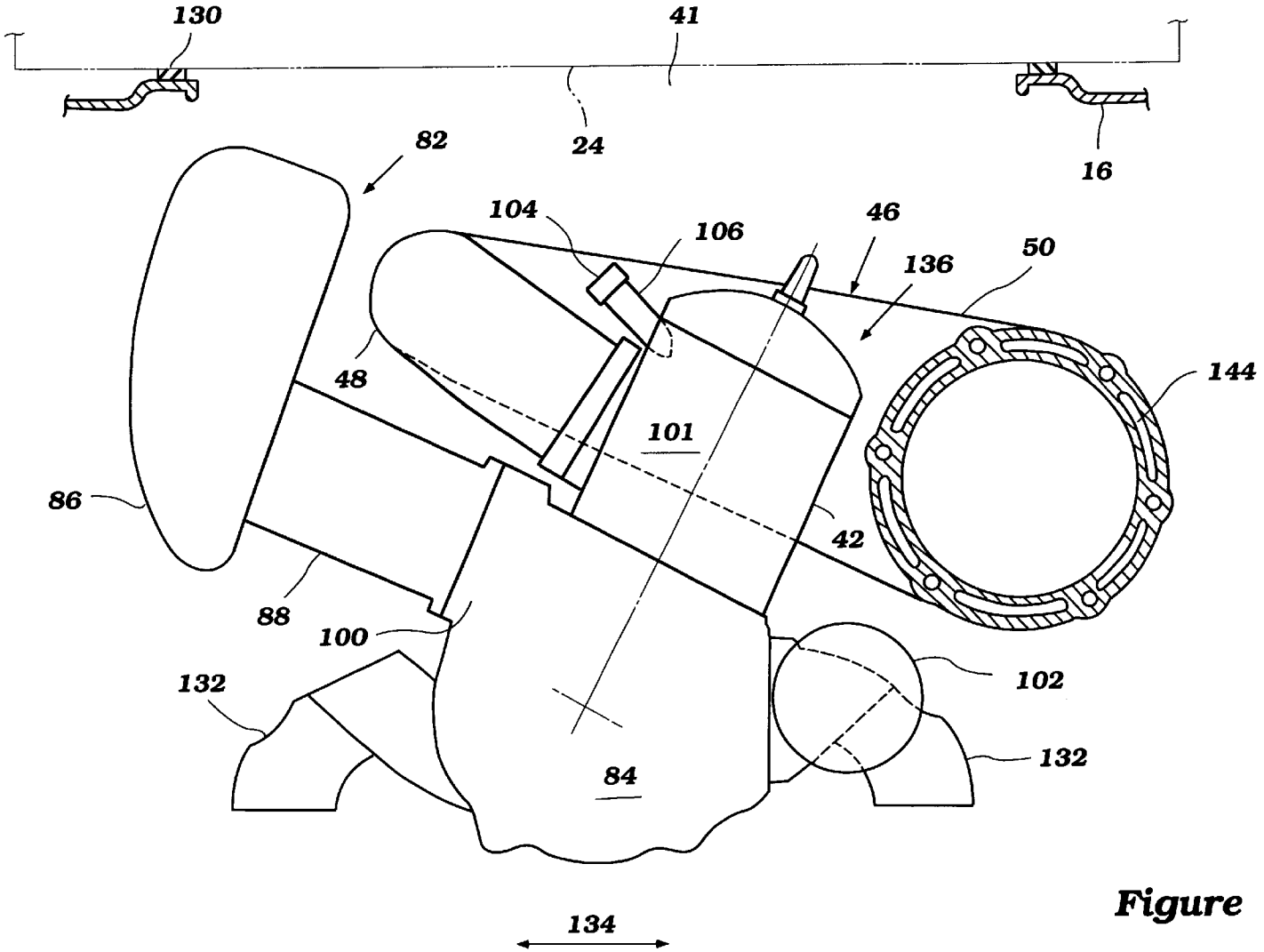
FIG. 9 is a front elevational view of the engine of FIG. 8.

FIGS. 8 and 9 illustrate another embodiment of the fuel pump arrangement according to the present invention. In this embodiment, the exhaust manifold 48 extends from the cylinder block 101 at a side opposite to the embodiment shown in FIGS. 6 and 7. Like the embodiment of FIGS. 6 and 7, the fiel pump 102 is mounted below the cylinder block 101. The inclined cylinder block 101 and the exhaust pipe 50 protect at least a part of the fuel pump 102 from the water that may enter the engine compartment 28.

The present engine is particularly useful with personal watercraft. This environment of use, however, is merely exemplary. The present engine is also suitable for other types of watercraft as well, for example small jet boats and the like, as well as for use in other applications. It also is understood that various aspects of each of the above-described embodiments can be combined together in order to suit a specific application. Other embodiments apparent to those of ordinary skill in the art are also within the scope of this invention. Accordingly, the scope of the invention is intended to be defined only by the claims that follow.

What is claimed is:

1. A watercraft comprising a hull that defines an engine comportment and an engine contained within said engine compartment, said engine compartment having an access opening positioned above said engine for access thereto, said engine including an exhaust system air intake system and a fuel pump supplying fuel to fuel injectors of said engine at a pressure sufficient for fuel injection, said fuel pump being positioned on said engine such that at least one of the intake system and exhaust system extends directly over the fuel pump so as to at least partially shield the fuel pump from water that may pass through said access opening in said engine compartment.

2. The watercraft of claim 1, wherein said fuel pump is mounted below said air intake system.

3. The watercraft of claim 2, wherein said fuel pump is mounted on said air intake system.

4. The watercraft of claim 3, wherein said air intake system includes an air silencer, and said fuel pump is mounted below said silencer so as to be shielded by said air silencer.

5. A watercraft comprising a hull that defines an engine compartment and an engine contained within said engine compartment, said engine compartment having an access opening positioned above said engine for access thereto, said engine including an air intake system and a fuel pump supplying fuel to said engine, said fuel pump being positioned on said engine so as to be at least partially shielded from water that may pass through said access opening in said engine compartment, wherein said air intake system further includes an intake pipe that connects said intake silencer to said engine, and said fuel pump is mounted on said intake pipe so as to cool the fuel pump.

6. The watercraft of claim 2, wherein said engine comprises a crankcase from which a cylinder upwardly extends, and said fuel pump is mounted on the outside of said crankcase.

7. The watercraft of claim 6, wherein said fuel pump is mounted at least partially beneath said air intake system so that said air intake system is positioned between said access opening in said engine compartment and said fuel pump.

8. The watercraft of claim 7, wherein said air intake system includes a silencer, and said fuel pump is mounted below said silencer so that said silencer at least partially shields said fuel pump.

9. The watercraft of claim 2, wherein a starting motor that initiates the operation of said engine is positioned within said engine compartment and is arranged on said engine in line with said fuel pump along a longitudinal axis of the watercraft such that the air intake system also extends above at least a portion of said starting motor.

10. The watercraft of claim 1, wherein the exhaust system comprises an exhaust manifold that extends from said engine to expel exhaust gases therefrom, wherein the fuel pump is mounted below the exhaust manifold and is arranged such that the shielding of said fuel pump is provided at least partially by exhaust manifold.

11. The watercraft of claim 10, wherein said engine comprises a crankcase from which a cylinder upwardly extends, and said fuel pump is mounted on the outside of said crankcase.

12. The watercraft of claim 10 wherein a starting motor that initiates the operation of said engine is positioned within said engine compartment and is arranged on said engine in line with said fuel pump along a longitudinal axis of the watercraft such that said exhaust manifold extends above at least a portion of said starting motor.

13. The watercraft of claim 1 wherein said fuel pump is mounted below an exhaust pipe that extends from said engine to expel exhaust gases from said engine and is arranged such that the shielding of said fuel pump is provided at least partially by said exhaust pipe.

14. The watercraft of claim 13, wherein said engine comprises a crankcase from which a cylinder upwardly extends, and said fuel pump is mounted on the outside of said crankcase.

15. The watercraft of claim 13, wherein a starting motor that initiates the operation of said engine is positioned within said engine compartment and is arranged on said engine in line with said fuel pump along a longitudinal axis of said watercraft such that said exhaust pipe extends above at least a portion of said starting motor.

16. The waterciafi of claim 1, wherein said engine comprises at least one combustion cylinder, and said fuel pump is positioned below said at least one combustion cylinder so that said cylinder shields said fuel pump.

17. The watercraft of claim 16, wherein a starting motor that initiates the operation of said engine is positioned within said engine compartment and is arranged on said engine in line with said fuel pump along a longitudinal axis of the watercraft such that said combustion cylinder extends above at least a portion of said starting motor.

18. The watercraft of claim 1, wherein said fuel pump is positioned above a lower outlet of an air duct leading into said engine.

19. The watercraft of claim 1, wherein said fuel pump is positioned above a water pickup of a water removal system that is positioned proximate to a lower side of said engine.

20. The watercraft of claim 1, wherein at least one side of said engine is elastically supported by a pair of engine mounts, and said fuel pump is positioned between said pair of engine mounts.

21. A watercraft comprising a hull that defines an engine compartment having an access opening thereto, an engine contained within said engine compartment and including an output shaft which powers a propulsion device through a shaft coupling, an air intake system, an exhaust system to expel exhaust gases from said engine, and a fuel supply system that supplies fuel to said engine, said fuel supply system including a fuel pump supplying fuel to fuel injectors of said engine at a pressure sufficient for fuel injection and positioned on said engine between a front end of the engine and said shaft coupling.

22. The watercraft as in claim 21, wherein at least a portion of said engine lies directly beneath said access opening.

23. The watercraft of claim 21, wherein said fuel pump is mounted below said air intake system so that said air intake system shields at least a portion of said fuel pump from water that may enter through said access opening.

24. The watercraft of claim 23, wherein said air intake system includes a silencer.

25. The watercraft of claim 21, wherein a starting motor that initiates the operation of said engine is positioned within said engine compartment and is arranged on said engine in line with said fuel pump along a longitudinal axis such that air intake system also extends above at least a portion of said starting motor.

26. A watercraft comprising a hull that defines an engine compartment having an access opening thereto, an engine contained within said engine compartment and including an output shaft which powers a propulsion device through a shaft coupling, an air intake system, an exhaust system to expel exhaust gases from said engine, and a fuel supply system that supplies fuel to said engine, said fuel supply system including a fuel pump positioned on said engine between a front end of the engine and said shaft coupling, wherein said air intake system additionally includes an intake pipe, and wherein said fuel pump is mounted on said air intake pipe, so as to cool the fuel pump.

27. The watercraft of claim 21, wherein said fuel pump is mounted below said exhaust system so tat said exhaust system at least partially shields said fuel pump from water that may enter through said access opening.

28. The watercraft of claim 27, wherein said exhaust system includes an exhaust manifold that extends from said engine, and said fuel pump is mounted below said exhaust manifold.

29. The watercraft of claim 27, wherein said exhaust system includes an exhaust pipe that extends from said engine and said fuel pump is mounted below said exhaust pipe.

30. The watercraft of claim 21, wherein said fuel pump is positioned above a lower outlet of an air duct leading into said engine compartment.

31. The watercraft of claim 21, wherein said fuel pump is positioned above a water pickup of a water removal system that is positioned proximate a lower side of said engine.

32. The watercraft of claim 21, wherein at least one side of said engine is elastically supported by a pair of engine mounts, and said fuel pump is positioned between said pair of engine mounts.

33. The watercraft of claim 21, wherein a flywheel assembly is coupled to the front end of the engine output shaft.

34. An engine comprising an air intake system, a fuel delivery system, and an exhaust system wherein said fuel delivery system includes a fuel pump supplying fuel to fuel injectors of said engine at a pressure sufficient for fuel injection and mounted on said engine so as to be shielded at least partially by either said air intake system or said exhaust system so as to minimize the exposure of said fuel pump to water that inadvertently comes into contact with said engine.

35. The engine of claim 34, wherein said fuel pump is located between one end of an output shaft of said engine and a flywheel assembly coupled to said output shaft.

36. The engine of claim 34, wherein at least one side of said engine is supported by a pair of engine mounts, and said fuel pump is positioned between said pair of engine mounts.

37. The engine of claim 34, wherein a starting motor that initiates the operation of said engine is arranged on said engine in line with said fuel pump along an axis generally parallel to a rotational axis of an output shaft of said engine such that said starting motor is also shielded by either said air intake system or said exhaust system.

38. A watercraft comprising a hull that defines an engine compartment having an access opening thereto, an engine contained within said engine compartment and including an output shaft which powers a propulsion device through a shaft coupling, a flywheel assembly coupled to said output shaft, an air intake system, an exhaust system to expel exhaust gases from said engine, and a fuel supply system that supplies fuel to said engine, said fuel supply system including a fuel pump supplying fuel to fuel injectors of said engine at a pressure sufficient for fuel injection and positioned on said engine between said flywheel assembly and said shaft coupling.

39. The watercraft of claim 38, wherein the flywheel assembly is coupled to the front end of the engine output shaft.

40. The watercraft of claim 38, wherein said fuel pump is mounted below said air intake system so that said air intake system shields at least a portion of said fuel pump from water that may enter through said access opening.

41. The watercraft of claim 38, wherein a starting motor that initiates the operation of said engine is positioned within said engine compartment and is arranged on said engine in line with said fuel pump along a longitudinal axis such that air intake system also extends above at least a portion of said starting motor.

42. The watercraft of claim 38, wherein said air intake system additionally includes an intake pipe, and wherein said fuel pump is mounted on said air intake pipe.

43. The watercraft of claim 38, wherein said fuel pump is mounted below said exhaust system so that said exhaust system at least partially shields said fuel pump from water that may enter through said access opening.

44. The watercraft of claim 43, wherein said exhaust system includes an exhaust manifold that extends from said engine, and said fuel pump is mounted below said exhaust manifold.

45. The watercrat of claim 43, wherein said exhaust system includes an exhaust pipe that extends from said engine and said fuel pump is mounted below said exhaust pipe.

46. The watercraft of claim 38, wherein said fuel pump is positioned above a lower outlet of an air duct leading into said engine compartment.

47. The watercraft of claim 38, wherein said fuel pump is positioned above a water pickup of a water removal system that is positioned proximate a lower side of said engine.

48. The watercraft of claim 38, wherein at least one side of said engine is elastically supported by a pair of engine mounts, and said fuel pump is positioned between said pair of engine mounts.

* * * * *

UNITED STATES PATENT AND TRADEMARK OFFICE

CERTIFICATE OF CORRECTION

PATENT NO. : 6,210,243 B1
DATED : April 3, 2001
INVENTOR(S) : Ryoichi Nakase

It is certified that error appears in the above-identified patent and that said Letters Patent is hereby corrected as shown below:

Column 8, claim 1,
Line 44, reads "comportment" and should read -- compartment --

Column 9, claim 10,
Line 30, reads "by exhaust" and should read -- by said exhaust --

Column 9, claim 16,
Line 55, reads "The waterciafi" and should read --The watercraft --

Signed and Sealed this

Nineteenth Day of March, 2002

*Attest:*

*Attesting Officer*

JAMES E. ROGAN
*Director of the United States Patent and Trademark Office*